US006298803B1

(12) United States Patent
Gregg

(10) Patent No.: US 6,298,803 B1
(45) Date of Patent: Oct. 9, 2001

(54) CAR LOCATOR

(76) Inventor: James E. Gregg, 970 Clark Ave., #C, Yuba City, CA (US) 95991

( * ) Notice: Subject to any disclaimer, the term of this patent is extended or adjusted under 35 U.S.C. 154(b) by 0 days.

(21) Appl. No.: 09/377,523

(22) Filed: Aug. 19, 1999

(51) Int. Cl.[7] ..... G09F 17/00

(52) U.S. Cl. ..... 116/28 R; 116/209; 340/425.5; 40/591

(58) Field of Search ..... 116/28 R, 30, 116/35 R, 42, 173, 209; 248/534, 539, 536; 362/249, 451, 543, 509, 487, 493, 503; 40/591, 592, 452, 442; 340/988, 925.5, 468, 471, 473

(56) References Cited

U.S. PATENT DOCUMENTS

| | | | | |
|---|---|---|---|---|
| 2,938,110 | * | 5/1960 | Busch et al. | 116/173 |
| 3,114,129 | * | 12/1963 | Gilbert | 116/173 |
| 3,485,469 | * | 12/1969 | Batcheller | 116/28 R |
| 3,812,815 | * | 5/1974 | Kuenzel | 116/28 R |
| 3,895,348 | * | 7/1975 | Palermo | 116/30 |
| 4,976,410 | | 12/1990 | Tomaiuolo . | |
| 4,986,209 | | 1/1991 | Spica . | |
| 5,089,803 | * | 2/1992 | Bohn | 340/425.5 |
| 5,233,938 | | 8/1993 | Lalo . | |
| 5,320,061 | * | 6/1994 | Laughlin et al. | 116/28 R |
| 5,388,546 | | 2/1995 | Lombard . | |
| 5,636,462 | * | 6/1997 | Kleiman | 40/591 |
| 5,692,331 | * | 12/1997 | Tipke | 40/591 |
| 5,786,758 | * | 7/1998 | Bullock | 340/539 |

* cited by examiner

*Primary Examiner*—Andrew H. Hirshfeld
(74) *Attorney, Agent, or Firm*—Patent & Trademark Services; Joseph H. McGlynn

(57) ABSTRACT

A car locator that uses a pluraity of visual indicators to help the owner locate a car in a crowded parking lot.

5 Claims, 1 Drawing Sheet

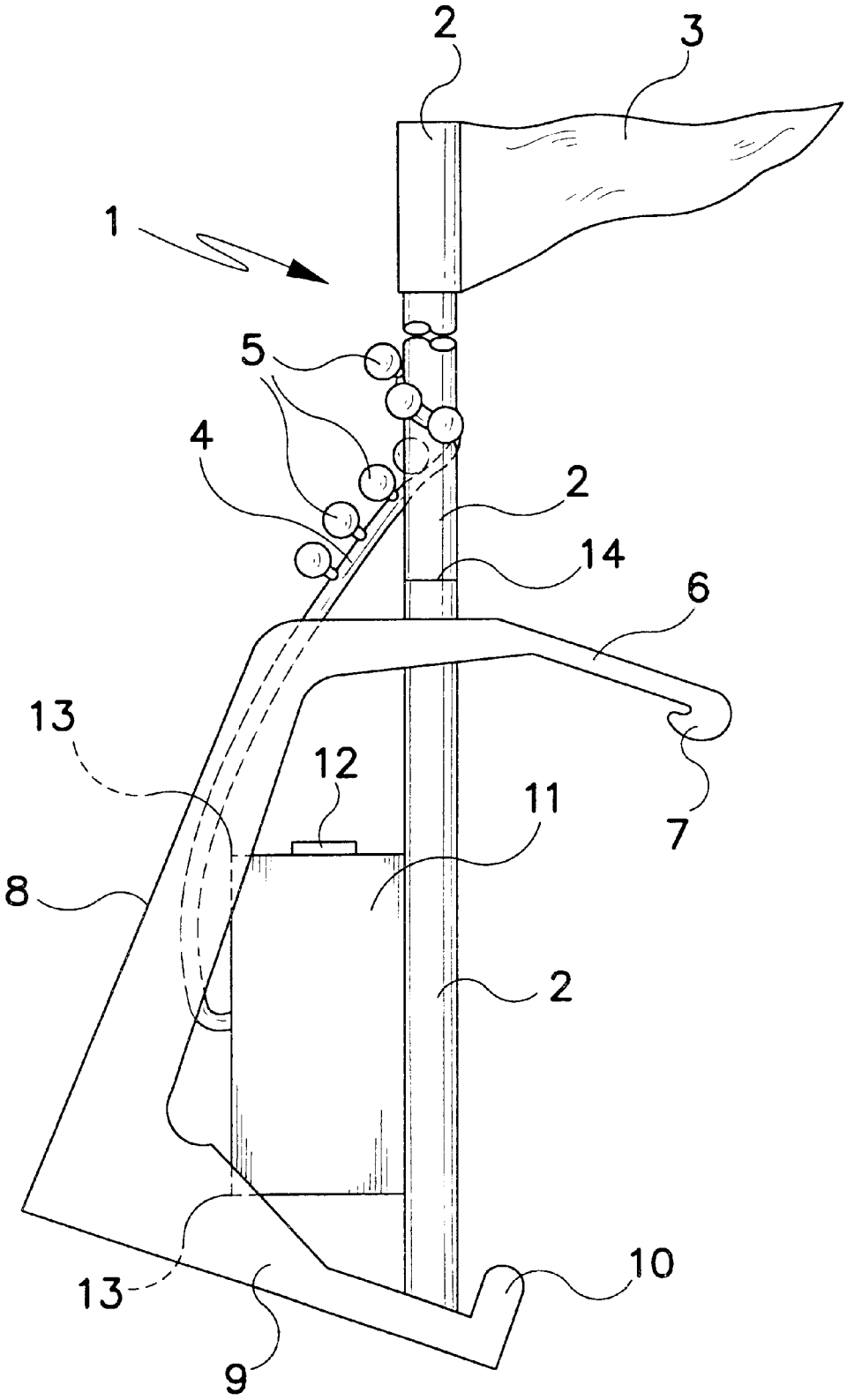
2
3
1
5
4
2
14
6
13
12
11
7
8
2
13
10
9

CAR LOCATOR

BACKGROUND OF THE INVENTION

This invention relates, in general, to a car locator, and, in particular, to a car locator which provides a plurality of visual locators.

DESCRIPTION OF THE PRIOR ART

In the prior art various types of car locators have been proposed. For example, U.S. Pat. No. 4,976,410 to Tomaiuolo discloses a car locator which has a bracket which holds a flag.

U.S. Pat. No. 4,986,209 to Spica discloses an emergency distress signal that mounts to the window of a car by means of a flagstaff that is collapsible.

U.S. Pat. No. 5,233,938 to Lalo discloses a vehicle flag with latches that hold the flag to a car window mount.

U.S. Pat. No. 5,388,546 to Lombard discloses a locator that is magnetically mounted to the roof of a car.

SUMMARY OF THE INVENTION

The present invention is directed to a car locator that uses a plurality of visual indicators to help the owner locate a car in a crowded parking lot.

It is an object of the present invention to provide a new and improved car locator.

It is an object of the present invention to provide a new and improved car locator that uses a plurality of visual devices.

It is an object of the present invention to provide a new and improved car locator that can be seen in various conditions.

These and other objects and advantages of the present invention will be fully apparent from the following description, when taken in connection with the annexed drawings.

BRIEF DESCRIPTION OF THE DRAWINGS

The Figure is side view of the present invention.

DESCRIPTION OF THE PREFERRED EMBODIMENT

Referring now to the drawings in greater detail, the Figure shows the car indicator of the present invention. The locator 1 has a shaft 2 with a brightly colored flag 3 attached to the top of the shaft 2 by any conventional means. As shown at 14, the shaft is a telescoping mast which comes in at least two telescoping parts and the overall length is approximately 48 inches open and 12 inches dosed. The shaft 2 is connected to a mounting bracket 6, 7, 8, 9, 10 in any conventional manner so when the bracket is attached to a vehicle the shaft 2 with the flag 3 will extend above the vehicle to make it easier for the vehicle owner to locate his/her vehicle in a crowded parking lot.

The mounting bracket is essentially C-shaped and has an upper arm 6 with a hook-shaped end 7 that will fit over the top of a vehicle window (not shown). Once the bracket is attached to the top of a vehicle window, the window is raised, thereby, trapping the top 6 of the bracket between the top of the window and the top portion of the vehicle window frame. This will prevent the bracket from being removed by unauthorized persons.

The bracket has a battery box 11 which is placed between the base 8 of the bracket and the mast 2 in order to secure it in place. The base 8 has at least two apertures therein which will receive the corners 13 of the battery box 11 to help secure it in place. The battery box can be removed by merely snapping it out of the recesses and from between the mast 2 and the base 8 of the bracket The material of the bracket should be such as to allow some flexibility to allow the battery box to be removed in order to replace the batteries (not shown) which are contained in the box 11.

The battery box 11 has an electrical wire 4 mechanically and electrically connected thereto. The wire 4 will be electrically connected to the batteries (preferably 2 C type batteries) and will be wrapped around the mast 2. Attached to the wire will be a plurality of lights 5 which will be lit by the electrical energy from the batteries. The lights wrapped around the mast 2 will make the vehicle more visible in low light situations.

The battery box 11 will have a switch 12 which will turn on and/or off the lights 5. The switch can be any conventional switch which will serve the intended purpose.

In order to use the car locator 1, the user would lower the window of his/her vehicle after it is parked. The top arm 6 of the bracket will be passed over the top of the window until the hook portion 7 is inside the vehicle and the bottom arm with the end 10 is against the outside of the window. Then the window will be raised until the top arm 6 is trapped by the top of the window. Next, the switch 12 will be turned on, thereby lighting the lights 5 which will be visible as they extend around the mast 2.

Although the Car Locator and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A car locator comprising:

a bracket means for attachment to a car window, a mast attached to said bracket means, a first visual indicator attached adjacent a top of said mast, and a second visual indicator attached along a longitudinal extent of said mast, and wherein said second visual indicator is a string of lights which are wrapped around said mast, and a battery box electrically connected to said string of lights, said battery box being secured between said bracket means and said mast, wherein said bracket means is made from flexible material permitting said bracket means to flex for removal of said battery box.

2. The car locator as claimed in claim 1, wherein said battery box has a switch means for turning on and off said string of lights.

3. The car locator as claimed in claim 1, wherein said first visual indicator is a flag.

4. The car locator as claimed in claim 1 wherein said mast is a telescoping mast that has at least two telescoping sections.

5. A car locator comprising:

a bracket means for attachment to a car window, a mast attached to said bracket means, a first visual indicator attached adjacent a top of said mast, and a second visual indicator attached along a longitudinal extent of said mast, and wherein said second visual indicator is a string of lights which are wrapped around said mast, and wherein said bracket means has a pair of recesses for receiving portions of a battery box, said battery box electrically connected to said string of lights, said battery box being secured between said bracket means and said mast, wherein said bracket means is made from flexible material permitting said bracket means to flex for removal of said battery box.

* * * * *